US010219563B2

(12) United States Patent
Bailey-Woods et al.

(10) Patent No.: US 10,219,563 B2
(45) Date of Patent: Mar. 5, 2019

(54) GARMENT COMPRISING MULTIPLE LAYERS

(71) Applicant: Burberry Limited, London (GB)

(72) Inventors: Christopher Paul Bailey-Woods, London (GB); Wally Faulds, London (GB)

(73) Assignee: Burberry Limited, London (GB)

( * ) Notice: Subject to any disclaimer, the term of this patent is extended or adjusted under 35 U.S.C. 154(b) by 479 days.

(21) Appl. No.: 14/086,362

(22) Filed: Nov. 21, 2013

(65) Prior Publication Data

US 2014/0137309 A1 May 22, 2014

(30) Foreign Application Priority Data

Nov. 22, 2012 (GB) ..... 1221041.5

(51) Int. Cl.

| | |
|---|---|
| ***A41D 1/02*** | (2006.01) |
| ***A41D 27/06*** | (2006.01) |
| ***A41D 31/02*** | (2006.01) |

(52) U.S. Cl.

CPC ..... *A41D 31/02* (2013.01); *A41D 1/02* (2013.01); *A41D 27/06* (2013.01)

(58) Field of Classification Search

CPC ..... A41D 31/02; A41D 1/02; A41D 27/06
See application file for complete search history.

(56) References Cited

U.S. PATENT DOCUMENTS

| | | | | | |
|---|---|---|---|---|---|
| 349,274 | A * | 9/1886 | Graser | A41D 27/06 | 2/255 |
| 762,359 | A * | 6/1904 | Steinberg | A41D 27/06 | 2/255 |
| 956,238 | A * | 4/1910 | Warren | A41D 1/02 | 2/93 |
| 1,106,199 | A * | 8/1914 | Fink | A41D 27/06 | 2/255 |
| 2,121,836 | A * | 6/1938 | Steinberger | A41D 27/06 | 2/236 |
| 3,639,914 | A * | 2/1972 | Ellman | A41D 1/02 | 2/268 |

(Continued)

FOREIGN PATENT DOCUMENTS

| | | |
|---|---|---|
| CN | 201438857 U | 4/2010 |
| CN | 201509670 | 6/2010 |

(Continued)

OTHER PUBLICATIONS

European Search Report dated Jan. 30, 2014.

(Continued)

*Primary Examiner* — Sally Haden
(74) *Attorney, Agent, or Firm* — Christopher M. Scherer; DeWitt LLP

(57) ABSTRACT

A garment comprising an outer layer on the exterior of a front part of the garment, a lining on the interior of the garment and an internal structure located between the outer layer and the lining. The internal structure comprises of a chest piece which extends from a shoulder part of the garment across a chest part of the garment without extending through to a lapel part of the garment and also a fusible material fused to the outer layer wherein the fusible material is located only partially across the outer layer.

23 Claims, 5 Drawing Sheets

(56) References Cited

U.S. PATENT DOCUMENTS

| | | | | |
|---|---|---|---|---|
| 4,214,319 | A * | 7/1980 | Bollag | A41D 1/02 156/93 |
| 4,796,305 | A * | 1/1989 | Itoh | A41D 1/02 2/255 |
| 5,669,072 | A | 9/1997 | Bjorklund | |
| 7,000,552 | B2 * | 2/2006 | Kim | A41D 27/06 112/418 |
| 2003/0196250 | A1 * | 10/2003 | Gadot | A41B 1/02 2/243.1 |
| 2005/0278824 | A1 * | 12/2005 | Gadot | A41D 1/02 2/108 |

FOREIGN PATENT DOCUMENTS

| | | |
|---|---|---|
| CN | 201894197 | 7/2011 |
| CN | 202026815 | 11/2011 |
| CN | 202085757 U | 12/2011 |
| GB | 1058704 | 2/1967 |
| GB | 1518761 | 7/1978 |
| JP | 2002115110 | 4/2002 |
| JP | 2011052333 | 3/2011 |

OTHER PUBLICATIONS

Search Report for GB1221041.5 dated Mar. 14, 2013.
Office Action for Chinese Application No. 201310598155.5 dated Jun. 1, 2016.
Office Action for Chinese Application No. 201310598155.5 dated Feb. 4, 2017.

* cited by examiner (Prior Art)

(Prior Art)

GARMENT COMPRISING MULTIPLE LAYERS

CROSS-REFERENCE TO RELATED APPLICATIONS

The present application claims priority of British Patent Application 1221041.5, filed Nov. 22, 2012, the content of which is incorporated herein by reference in its entirely.

FIELD OF DISCLOSURE

The present invention relates to a garment comprising multiple layers, for example an item of outerwear or a jacket such as a suit jacket.

BACKGROUND

Traditionally, suit jackets were fully canvassed, meaning they were constructed with a layer of canvas stitched between the outer layer and the lining. In a fully canvassed jacket, the internal structure, the canvas, runs from the top of the shoulder to the bottom hem and under the lapel, the purpose of which is to provide the jacket with structure and to prevent deformation and sagging. This form of structuring is expensive both in terms of the materials used and the labour involved to create it. There is also a risk that if the canvas is poorly-inserted or shrinks after insertion the front of the suit will pucker which is almost impossible to fix on a completed garment.

With the development of fusible materials an increasing number of fused suit jackets have appeared on the commercial market. Fusible fabrics comprise a heat sensitive resin which allows them to be effectively "fused" to the outer layer of the front portion of the jacket without stitching. In fused suit jackets, the fusing replaces the canvas portion of the internal structure. The fusing starts at approximately the top of the shoulder and runs down to the bottom hem and under the lapel. The only canvas that is kept is a chest piece that does not extend to the lapels and stops under the arm to reinforce the shape of the garment. The risk of using fusible materials is that if heat, or steam, is applied to the suit, for example during dry cleaning or in a humid atmosphere, the internal structure, in this case the fusing material, can become detached from the outer layer. This effect is known as "bubbling" and is permanent. The direct attachment of the fusible material to the front of the jacket has a stiffening effect on the material which does not provide the same support as the fully-canvassed suit. Also since there is no canvassing in the lapels this gives them a flat and lifeless look.

More recently, half-canvassed suit jackets have been developed. In half-canvassed jackets the internal structure comprises a chest piece that starts at approximately the top of the shoulder, extends under the lapel and ends approximately half-way down the length of the front portion of the jacket. It also contains fusing that runs from the top of the shoulder all the way down to the bottom seam without extending under the lapel. Since this form of structuring comprises of fusible material it also causes the front of the jacket to stiffen and runs the risk of bubbling.

It is desirable to improve the fit and comfort of the suit and to reduce the weight while also reducing the effects of bubbling in order to increase the longevity of the suit. In the past, research has involved developing new resin for fusible materials which can then be applied to the whole of the suit while reducing its sensitivity to bubbling.

SUMMARY OF DISCLOSURE

In a first aspect of this disclosure, there is provided a garment comprising:

- an outer layer on the exterior of a front part of the garment; and
- an internal structure located on an inner side of the outer layer;
- wherein the internal structure comprises: a chest piece which extends from a shoulder part of the garment or outer layer across a chest part of the garment or outer layer without extending through to a lapel part of the garment or outer layer, and a fusible material fused to the outer layer, wherein the fusible material is located only partially across or on the outer layer.

There may be a lining located on or over the interior of the garment, and the internal structure may be located between the outer layer and the lining. The lining may be stitched to the outer layer, e.g. at the border or seams of the lining and/or outer layer.

The terms "outer", "inner" and "internal" are intended to refer to sides of garment when worn conventionally, or in use. "Outer" refers to the external or outermost side of the garment when being worn conventionally on a body or model, and "inner" or "internal" refers to an opposing side to the outer side, such as the side which faces the body or model with respect to the outer layer when the garment is worn conventionally on the body or model. The reference to the front part of the garment above is a reference to a section of the garment which may normally be worn on the front of a body, such as a human body, or model, for example extending vertically from a ridge of the shoulder part of the garment to its bottommost part during conventional wearing of the garment, and horizontally from a centreline during conventional wearing which would extend from the centre of the body to a line under the arm. The reference to a "line under the arm" is a reference to a line which would normally sit or be located under an arm extending down vertically towards the ground when the garment is being worn on a standing body or other standing model. The section of the garment reference hereinbefore may simply be one side of the front of the garment, such as one half of the front of the garment.

The term "extend" means that one material part covers or is located on a surface of another material part or parts. Thus, when it is said that chest piece or fusing does not "extend" over the outer layer, this means that a section of the outer layer is not covered by the chest piece or fusing, and that the chest piece or fusing is not located over or against the out layer, e.g. on its internal surface.

The chest piece may be stitched or fused to the outer layer and/or lining to hold in position against the outer layer. The chest piece may be stitched or fused in one or more discrete locations against the outer layer and/or lining, e.g. in or at least 1, 2, 3, 4, 5, 6, 7, 8, 9, 10, 15 or 20 locations.

The garment's internal structure is flatter, lighter and more flexible than conventional garments since the chest piece does not extend across the whole of the garment. As a result of its position in the garment, it is able to mould and adapts to both the fabric lining and outer layer and the wearer of the garment itself. This internal structure thus maintains the shape and holds the structure of the garment while allowing extension and maximum movement across the front of the garment. This is particularly so because the chest piece does not extend to a lapel part of the garment which does not constrain movement and position of the chest part whilst it is being worn.

The chest piece may not extend under an arm part of the front part of the garment. This allows for maximum movement of the arm without making the garment rigid when moving the arm. Preferably, the chest piece of the internal structure may comprise or consist of one or more of: wool, a blend of wool, cotton and animal hair, such as horse hair and/or camel hair. This layered structure allows increased flexibility. The arm part may be a section of the garment which would normally sit under an arm extending down vertically towards the ground when the garment is being worn on a standing body or other standing model.

Advantageously, the internal structure may comprise, cover or be positioned across or underneath no more than 40%, 50%, 60%, 70% or 80% of the surface area of the outer layer of the front part of the garment. This reduced surface area reduces the weight of the garment and provides greater flexibility in its wearing. The chest piece may comprise, cover or be positioned across or underneath no more than 10%, 20%, 30%, 40% or 50% of the outer layer of the front part of the garment.

Preferably, the fusible material may extend over at least some, or all of a lapel part of the garment. This reinforces the lapel and prevents it from having a flat lifeless appearance, whilst not having the full conventional reinforcement of the chest piece. The fusible material may extend to a collar part of the garment.

In one embodiment, the fusible material may extend from the shoulder part of the garment, across the chest part and through a lapel part of the garment without extending under an arm part of the front part of the garment.

Advantageously, the fusible material may cover or be located across or underneath no more than 40%, 50%, 60%, 70% or 80% of the surface area of the outer layer. This reduces the chance that bubbling may occur.

Preferably, the lapel part of the garment may comprise a reinforcement structure between the outer layer and the lining. This also prevents the lapel from appearing flat and lifeless.

Preferably, the shoulder part of the garment may comprise a reinforcement structure between the outer layer and the lining. This shoulder reinforcement adds structure to the garment without adding extra weight.

Preferably, the collar part of the garment may comprise a reinforcement structure between the outer layer and the lining.

In one embodiment of the invention, the reinforcement material of the shoulder part may comprise or consist of one or more of: wool, a blend of wool, cotton and animal hair, such as horse hair and/or camel hair.

Preferably, the reinforcement structure may be of a different composition to the chest piece. The reinforcement structure may be fused to the lapel part.

In one embodiment of the invention, the garment is an item of outerwear, for example a jacket, such as suit jacket.

In a second aspect of the disclosure, there is provided a method of manufacturing a garment comprising:

providing an outer layer of a front part of a garment; and providing an internal structure located on an internal side of the outer layer, wherein providing the internal structure comprises:

providing a chest piece which extends from a shoulder part of the garment across a chest part of the garment without extending through to a lapel part of the garment, and providing a fusible material fused to the outer layer, wherein the fusible material is located only partially across the outer layer.

BRIEF DESCRIPTION OF THE DRAWINGS

The present invention is described in greater detail below in conjunction with the accompanying drawings in which.

DETAILED DESCRIPTION

Figure 2:
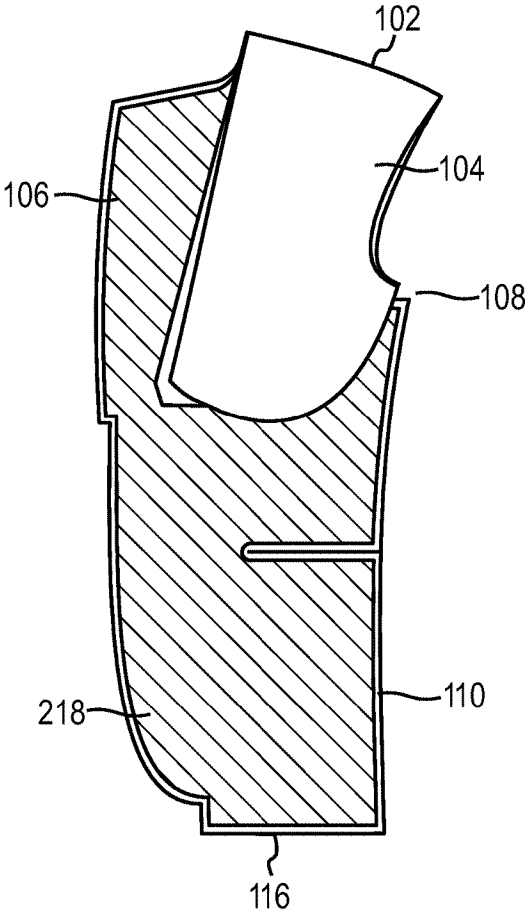
FIG. 2 is a plan view of the internal structure of a front panel of a fully fused suit of the prior art.
Figure 1:
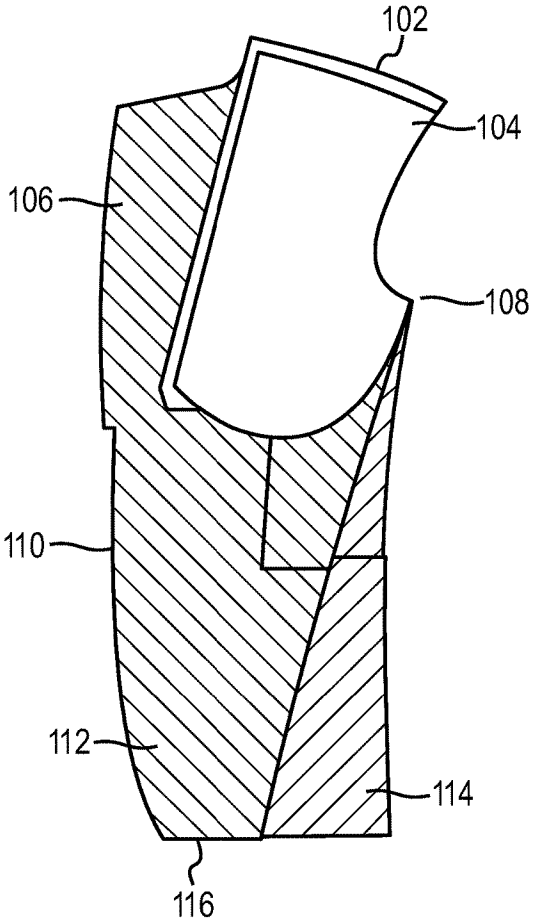
(Prior Art) FIG. 1
FIG. 1 is a plan view of the internal structure of a front panel of a fully canvassed suit of the prior art.
Figure 3:
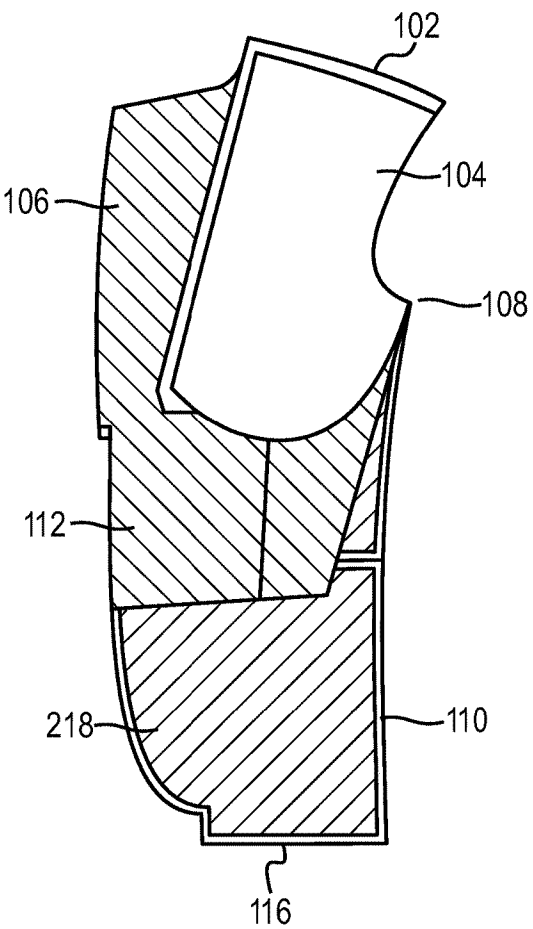
FIG. 3 is a plan view of the internal structure of a front panel of a half-canvassed suit of the prior art.

FIGS. 1 to 3 are examples of garments of the prior art described below to aid the understanding of the invention which is described in detail in exemplary embodiments in FIGS. 4 to 8.

The term "canvas" used in this example is understood to mean a closely woven fabric which comprises or consists of one or more of: wool, a blend of wool, cotton and animal hair, such as horse hair and/or camel hair.

FIG. 1 is an example of the inside front panel 110 of a fully canvassed suit jacket of the prior art. It can be seen here that the canvas 112 is stitched onto the exterior cloth 114 from the shoulder 102 part of the jacket to the bottom hem 116, through the lapel 106 part without extending under the arm 108 part of the jacket. It can also be seen here that the chest piece 104 extends from the shoulder 102 part of the jacket approximately halfway down the front panel 110 without extending to the lapel 106 part.

FIG. 2 is an example of the inside front panel 110 of a fully fused suit jacket of the prior art. It can be seen here that the fusible material 218 is attached directly to the cloth exterior from the shoulder 102 part of the jacket to the bottom hem 116, through the lapel 106 part without extending under the arm 108 part of the jacket. There is also a chest piece or part 104 which extends from the shoulder 102 part of the jacket approximately halfway down the front panel 110 without extending to the lapel 106 part.

FIG. 3 is an example of the inside front panel 110 of a garment of the prior art which is a half-canvassed suit jacket. It can be seen that here that the garment comprises both a canvas 112 and fusible material 218. The fusible material extends from the shoulder 102 part of the jacket to the bottom hem 116 without extending under the arm 108 part or the lapel 106 part of the jacket. The canvas 112 extends from the shoulder 102 part of the jacket to approximately halfway down the front panel 110. There is also a chest piece 104 in this form of structuring.

Figure 4:
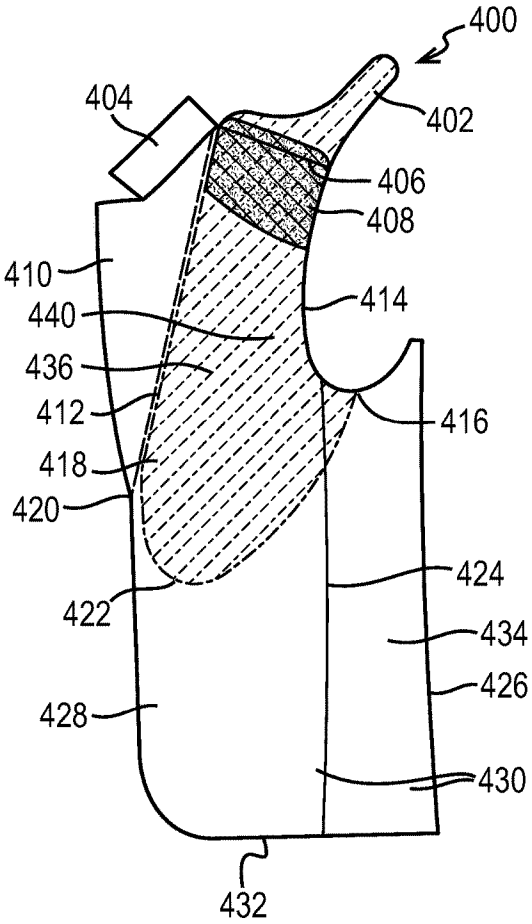
FIG. 4 is a plan view of the internal structure of the front and side panels of a garment according to the invention.

FIG. 4 is a section of a garment 400 according to an embodiment of the invention viewed internally where the front panel 428 and side panel 426 are visible. It can be seen here that the chest piece 418 (which may be a canvas chest piece) extends from the shoulder of the garment 400 down the front panel 428. The chest piece 418 may comprise a shoulder part 402 which extends beyond the shoulder seam 406 of the garment 400. There is also a shoulder reinforcement 408, such as a shoulder pad, which extends either side of the shoulder seam 406. The chest piece 418 does not extend into the collar 404 or the lapel 410 of the garment 400 but stops at the edge 412 of the lapel 410 with respect to the main body of the outer layer 430. The chest piece 418 does not reach the bottom hem 432 of the garment 400, but extends to a maximum extent at a point 422 between the end 420 of the lapel 410 and the bottom hem 432 on the front panel 428. In this regard, the border of the chest piece 418 is shaped in a curve which extends from an under arm seam point 416 to the end 420 of the lapel 410. The chest piece 418 does not extend over or under the arm part of the garment 400, but stops at the arm seam 414 along the front panel 428 and under the arm at a point just after side seam 424. The material not covered by the chest piece 418 is the outer layer 430 (which may be cloth) of the garment. FIG. 4 is shown so that the component parts of the garment can be seen for the purposes of illustration. However, it will be appreciated that the chest piece 418 and shoulder reinforcement 408 are arranged such that they are located on an internal side of the garment against an internal side of the outer layer 430. The shoulder reinforcement 408 is located between the chest piece 418 and outer layer 430, but the alternative is also possible such that the chest piece 418 is located between the outer layer 430 and the shoulder reinforcement 408.

Figure 5:
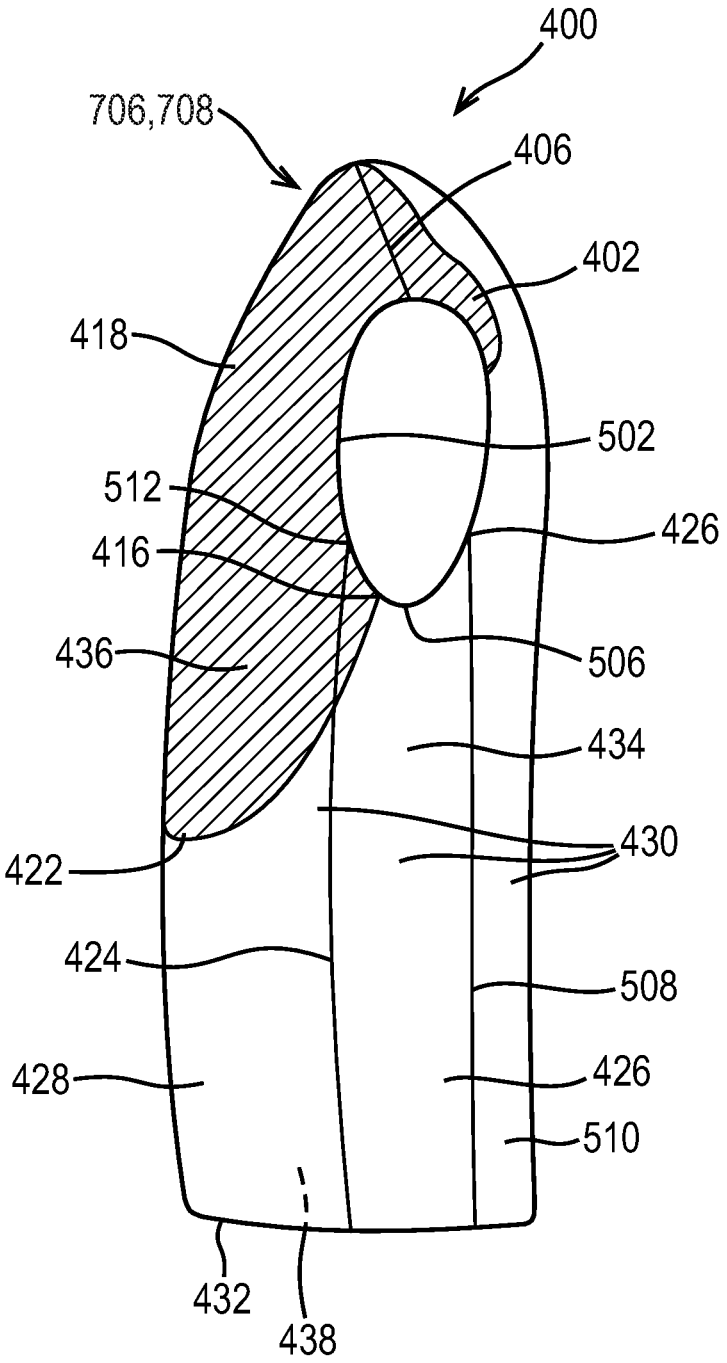
FIG. 5 is a side view of the internal structure of a garment according to the invention showing the canvas part.

FIG. 5 is a section of the garment 400 according to an embodiment of the invention. It is a side view where the front panel 428, side panel 426 and back panel 510 are visible. There is also a gap in the garment where the arm would be encompassed by the arm seam 502. It can be seen here that the chest piece 418 and a shoulder part 402 extends over the shoulder seam 406 of the garment 400 partly onto the back panel 510 of the garment 400. The chest piece 418 extends beyond side seam 424 onto the side panel 426 and joins the arm seam 502 at a point 416 before the bottom of the arm seam 506 and the seam joining the back and side panels 508. It can be seen more clearly here also that the chest piece 418 extends down the front panel 428 to a point under the bottom of the arm seam 506 but above the bottom hem 432. The material not covered by the chest piece 418 is the outer layer 430 of the garment 400.

Figure 5B:
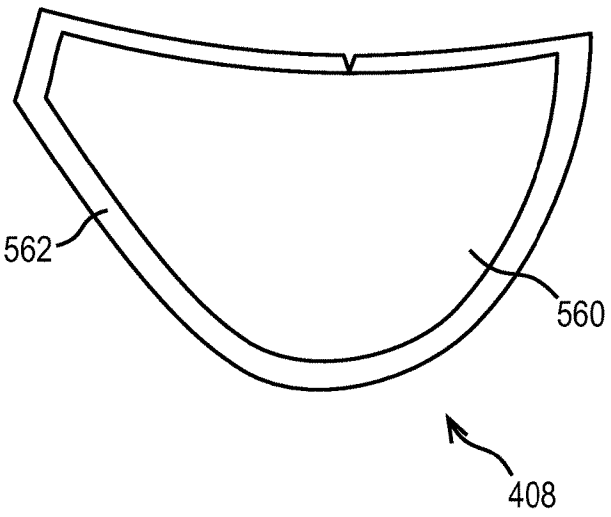
FIG. 5*b* is a plan view of the shoulder part of the internal structure of a garment according to the invention.
Figure 5A:
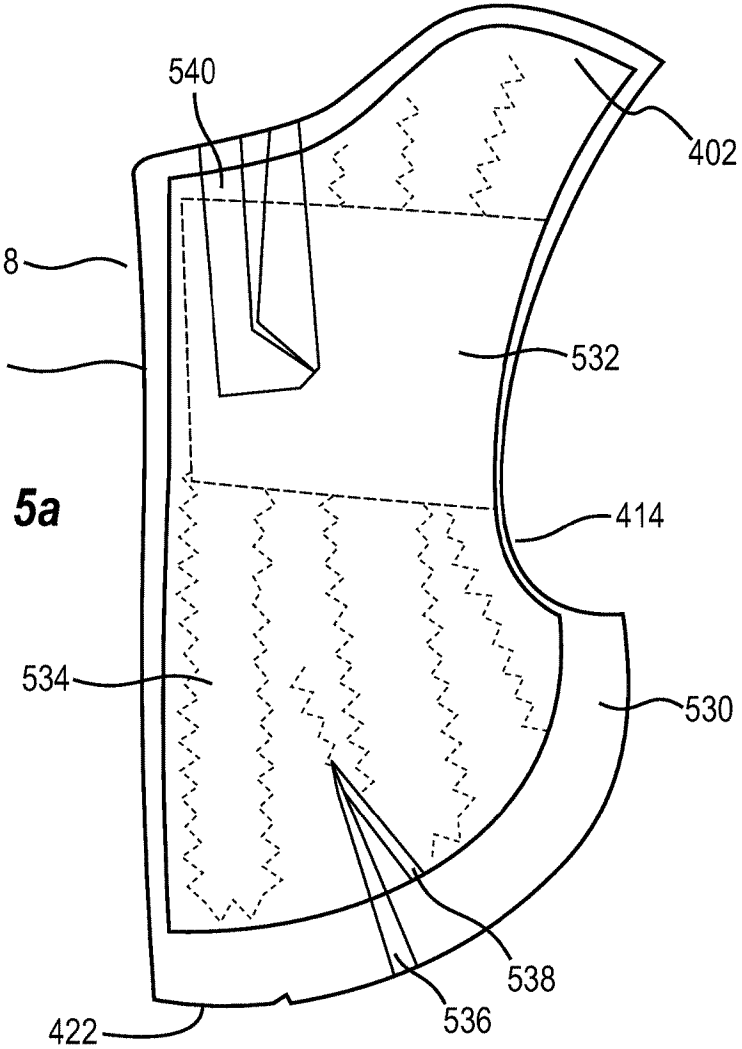
FIG. 5*a* is a sectional view of the chest piece of the internal structure of a garment according to the invention.

FIG. 5*a* is a sectional view of the chest piece 418 (which may be of canvas, i.e. form the "canvassing" of the front part of the garment 400) is made up of three layers, a first (e.g. base) layer 530 (which may be camel hair canvas), a second (e.g. intermediary) layer 532 (which may be animal hair (horse hair) canvas) and a third (e.g. top) layer 534 (which may be camel hair canvas).

The material of the first layer 530 and third layer 534 may be the same, and may be KO 250 camel hair canvas (weave: 1/1; weight: 105 g/m$^2$; total composition: 100% PES; warp: PES; weave: PES). The material of the second layer 532 may be 18/60 ZN D horse hair canvas (weight: 147 g/m2; composition: 45% cotton, 55% horse hair; warp content: 100% cotton, NE 60/2 yarn count, 34.5 wires/cm; weft content: 100% horse hair, 18 wires/cm). The first layer 530 may cover or extends over 25% to 45%, 30% to 40%, 32.5% to 37.5% or 35% of the second layer 532. The layers of the chest piece 418 may be attached or connected to each other through some limited stitching or fusing through the entire piece 418 at one or more discrete locations, for example at specifically, or no more than: 1, 2, 3, 4, 5, 6, 7, 8, 9, 10, 15 or 20 discrete locations. The second layer 532 may cover or extend over at least 5% to 15%, or 7.5% to 12.5% or 10% of the second layer 532. The third layer 534 may cover or extend over at least 20% to 50%, 25% to 35%, 27.5% to 32.5% or 30% of the second layer 532.

FIG. 5*b* is a plan view of the shoulder reinforcement 408 of the garment 400 which is placed over the shoulder seam 406 on top of the shoulder part 402 of the chest piece 418. It is composed of two layers of canvas, a base layer 562 and a layer small in cross-sectional area to the base layer 562 on top 560. The shoulder reinforcement 408 contains no wadding.

Figure 6:
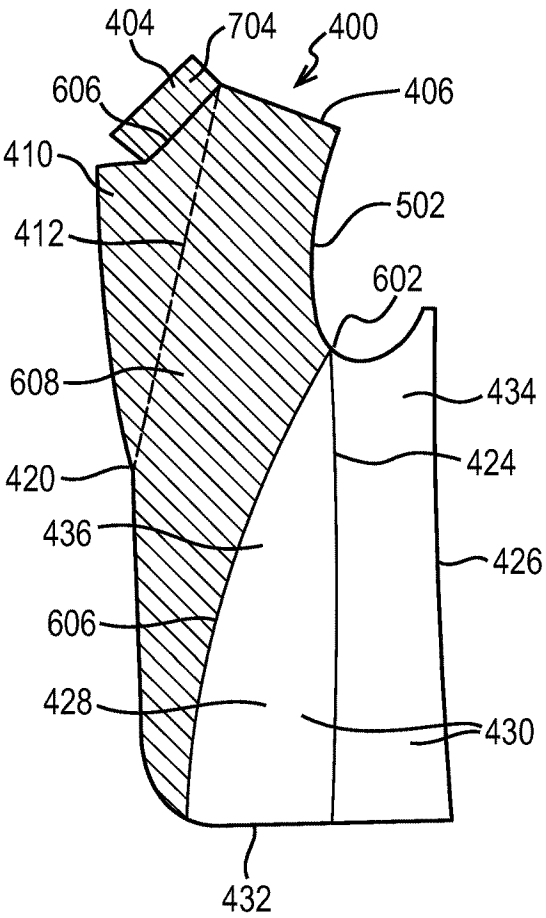
FIG. 6 is a further plan view of the internal structure of the front and side panels of a garment according to the invention showing the fusible material part.

FIG. 6 is a plan view of the garment 400 in an embodiment of the invention where the front panel 428 and side panel 426 are visible. It can be seen here that the fusible material 608 extends from the shoulder seam 406 of the garment 400 to the bottom hem 432 of the front panel 428. However it does not fully cover the front panel but the fusible material 608 has an edge 606 which is cut away from the point where the fusible material meets the arm seam and the front and side panels and tapers beyond the end of the lapel 420 towards the bottom hem 432, narrowing along the way. This point is the point 602 where the front part, the side seam and the arm seam meet. The rest of the material of the side and front panels is the outer layer 430. The fusible material 608 also does not extend beyond the arm seam 502 or onto the side panel 426 of the garment 400. It does extend beyond the edge of the lapel 412 through to the lapel 410 and beyond the collar seam 606 into the collar parts 404 of the garment 400. The fusible material 608 may be 8025 US3 Polyfix Multi Elastic (weight 25 g/m$^2$; composition: 100% texturised polyester; warp: polyester; weft: polyester; weave type: plain; resin type: copolyamide 25, irregular mesh distribution) and it may make up to 60 to 100% of the coverage of the front panel.

Figure 7:
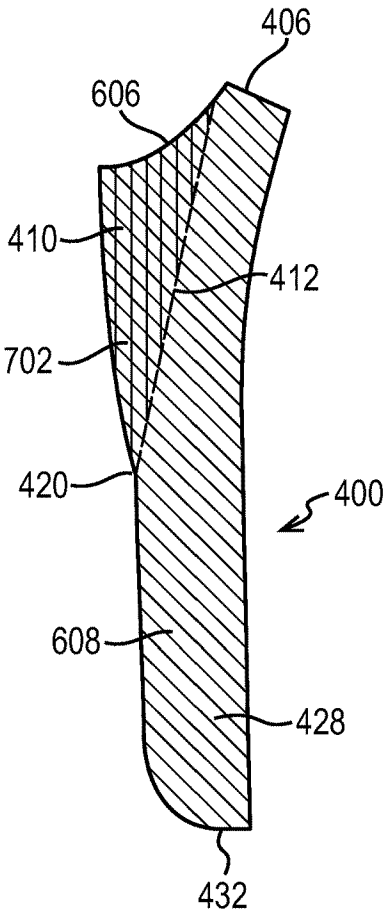
FIG. 7 is an enlarged plan view of the lapel part of the internal structure of the front panel of FIG. 6.

FIG. 7 is an enlarged view of the garment 400 in an embodiment of the invention where part of the front panel 428 is visible. It can be seen here in this example that the fusible material 608 extends from the shoulder seam 406 of the garment 400 to the bottom hem 432 of the front panel 428. It also extends through the lapel 410 of the garment 400. It can further be seen that there is a lapel reinforcement structure 702 in the lapel 410 part of the garment 400 which extends from the collar seam 606 to the end of the lapel 420 without going beyond the edge of the lapel 412. The lapel reinforcement structure 702 may be "Kufner Stretch 2000" fusible elastic weft (weight: approximately 100 g/m$^2$; total composition: 34% CV, 68% PES; warp: polyester/viscose; weft: polyester; weave type: satin weave ⅓; resin type: doublespot, 17 mesh) and it may make up approximately 5% of the coverage of the front panel.

Figure 8:
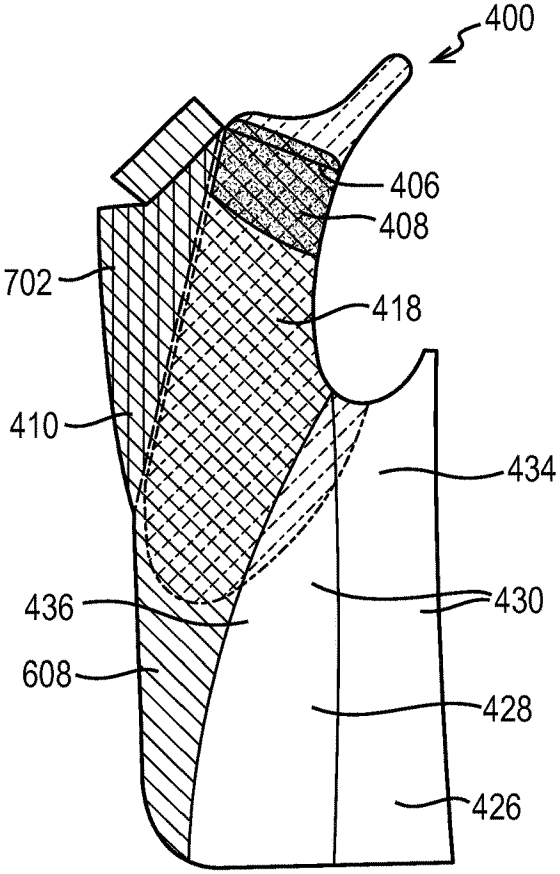
FIG. 8 is a plan view of the internal structure of the front and side panels of a garment according to the invention showing the canvas and fusible material parts.

FIG. 8 is a plan view of the garment 400 in an embodiment of the invention where the front panel 428 and side panel 426 are visible. Here all of the internal structure is visible, the fusible material 608 with the lapel reinforcement structure 702 in the lapel 410 and the chest piece 418 with the shoulder reinforcement 408 over the shoulder seam 406. The rest of the front and side panels is cloth.

While the preceding description contains many specifics, these specifics should not be construed as limitations on the scope of the invention, but merely as examples of the preferred embodiments. Those skilled in the art will envision other possible variations that are within the scope and spirit of the invention as defined by the following claims.

GLOSSARY OF REFERENCE NUMERALS USED IN FIGURES

102: Shoulder
104: Chest Piece
106: Lapel
108: Underarm
110: Front Panel
112: Canvas
114: Cloth
116: Bottom Hem
400: Garment
402 Shoulder
404: Collar
406: Shoulder Seam
408: Shoulder Reinforcement
410: Lapel
412: Lapel Edge
414: Edge of front panel/arm seam
416: Meeting point of canvas and underarm seam
418: Chest piece
420: End of Lapel
422: Bottom of Canvas
424: Side Seam
426: Side Panel
428: Front Panel
430: Outer Layer
432: Bottom Hem
434: Arm Part
436: Front Part
438: Lining
440: Chest Part
502: Arm Seam
506: Bottom of Arm
508: Seam joining Side and Back Panels
510: Back Panel
512: Joint of Front and Side Panel under Arm
530: Camel Hair Base Layer
532: Animal Hair Canvas Intermediary Layer
534: Camel Hair Top Layer
536: Location where Base and Top Layers Overlap to form curved shape
538: Location where Base and Top Layers Overlap to form curved shape
560: Layer 2
562: Layer 1
602: Point where the Front Part, the Side Seam and the Arm Seam meet
606: Collar Seam
608: Fusible Material
702: Lapel reinforcement structure
704: Collar reinforcement structure
706: Jacket
708: Suit Jacket

The invention claimed is:

1. A jacket comprising:
an outer layer on an exterior of a front part of the jacket,
an internal structure located on an internal side of the outer layer,
a side seam,
an arm seam, and
a bottom hem,
wherein the side seam extends from the arm seam to the bottom hem,
wherein the internal structure comprises:
a chest piece which extends from a shoulder part of the jacket across a chest part of the jacket without extending through to a lapel portion of the jacket, and
a fusible material fused to the outer layer,
wherein the outer layer is partially covered, but not entirely covered by the fusible material,
wherein the fusible material extends from the shoulder part of the jacket, across the chest part, through at least a substantial part of the lapel portion of the jacket, and to a point where the front part, the side seam, and the arm seam meet,
wherein the shoulder part of the jacket comprises a shoulder reinforcement, wherein the shoulder reinforcement comprises a shoulder pad,
wherein the fusible material extends over all of an inner side of the lapel portion of the jacket, wherein the fusible material extends continuously from the side seam to the lapel portion;
further comprising a lining on an interior of the jacket, wherein the internal structure is located between the outer layer and the lining.

2. The jacket of claim 1, wherein the chest piece of the internal structure comprises one or more of: wool, cotton, animal hair, or a blend of wool.

3. The jacket of claim 1, wherein the-piece-sf fusible material extends to a collar part of the jacket.

4. The jacket of claim 3, wherein the collar part of the jacket comprises a collar reinforcement structure between the outer layer and the lining.

5. The jacket of claim 1, wherein the lapel portion of the jacket comprises a lapel reinforcement structure between the outer layer and the lining.

6. The jacket of claim 5, wherein the lapel reinforcement structure is of a different composition to the chest piece.

7. The jacket of claim 5, wherein the lapel reinforcement structure is fused to the lapel portion.

8. The jacket of claim 1, wherein the shoulder reinforcement is between the outer layer and the lining.

9. The jacket of claim 8, wherein the shoulder reinforcement comprises one or more of: wool, cotton, animal hair, or a blend of wool.

10. The jacket of claim 8, wherein the shoulder reinforcement comprises one or more of horse hair and/or camel hair.

11. The jacket of claim 1, wherein the chest piece of the internal structure comprises horse hair and/or camel hair.

12. The jacket of claim 1, wherein the jacket is a suit jacket.

13. The jacket of claim 1, wherein the internal structure comprises no more than 70% of a surface area of the outer layer of the front part of the jacket.

14. The jacket of claim 1, wherein the internal structure comprises no more than 90% of a surface area of the outer layer of the front part of the jacket.

15. The jacket of claim 1, wherein the internal structure comprises at least 60% of a surface area of the outer layer of the front part of the jacket.

16. The jacket of claim 1, wherein the internal structure comprises at least 80% of a surface area of the outer layer of the front part of the jacket.

17. The jacket of claim 1, wherein the fusible material covers no more than 70% of a surface area of the outer layer.

18. The jacket of claim 1, wherein the fusible material covers no more than 90% of a surface area of the outer layer.

19. The jacket of claim 1, wherein the fusible material covers at least 60% of a surface area of the outer layer.

20. The jacket of claim 1, wherein the fusible material covers at least 80% of a surface area of the outer layer.

21. The jacket of claim 1, wherein the lapel portion further comprises a lapel seam at an outer edge of the lapel portion, wherein the lapel seam comprises stitching, wherein the stitching passes through the fusible material.

22. A method of manufacturing a jacket comprising:

providing an outer layer of a front part of a jacket, providing an internal structure located on an internal side of the outer layer, providing a side seam, providing an arm seam, and providing a bottom hem, wherein the side seam extends from the arm seam to the bottom hem, wherein providing the internal structure comprises:

providing a chest piece which extends from a shoulder part of the jacket across a chest part of the jacket without extending through to a lapel portion of the jacket, and providing a fusible material fused to the outer layer, wherein the outer layer is only partially covered, but not entirely covered by the fusible material wherein the fusible material extends from the shoulder part of the jacket, across the chest part, through at least a substantial part of the lapel portion of the jacket and to a point where the front part, the side seam, and the arm seam meet wherein the shoulder part of the jacket comprises a shoulder reinforcement, wherein the shoulder reinforcement comprises a shoulder pad, wherein the fusible material extends over all of an inner side of the lapel portion of the jacket, wherein the fusible material extends continuously from the side seam to the lapel portion;

further comprising a lining on an interior of the jacket, wherein the internal structure is located between the outer layer and the lining.

23. The method of manufacturing a jacket of claim 22, wherein the lapel portion further comprises a lapel seam at an outer edge of the lapel portion, wherein the lapel seam comprises stitching, wherein the stitching passes through the fusible material.

* * * * *